United States Patent [19]

Johnson

[11] Patent Number: 4,554,894

[45] Date of Patent: Nov. 26, 1985

[54] TWIN PISTON-PER-CYLINDER ENGINE

[76] Inventor: Wilfred B. Johnson, Star Rte., Box 3289A, Manistique, Mich. 49854

[21] Appl. No.: 548,975

[22] Filed: Nov. 2, 1983

[51] Int. Cl.[4] ..... F02B 25/12

[52] U.S. Cl. ..... 123/53 AA; 123/198 E; 180/291; 180/232

[58] Field of Search ..... 123/195 R, 195 C, 198 E, 123/53 AA, 53 BA, 51 R, 51 A, 51 AA, 51 B, 51 BA; 180/232, 291

[56] References Cited

U.S. PATENT DOCUMENTS

| | | | |
|---|---|---|---|
| 1,533,004 | 4/1925 | Henry | 123/53 AA |
| 4,151,822 | 5/1979 | Miura et al. | 123/198 E |
| 4,186,714 | 2/1980 | Danckert et al. | 123/198 E |
| 4,266,630 | 5/1981 | Nilsson et al. | 180/291 |
| 4,487,285 | 12/1984 | Tomita et al. | 180/291 |

*Primary Examiner*—Craig R. Feinberg
*Attorney, Agent, or Firm*—Harvey B. Jacobson

[57] ABSTRACT

An internal combustion engine has opposed cylinders defining a central combustion chamber therebetween. A pair of crankshafts are positioned outwardly of the respective cylinders by a distance which allows the pistons and connecting rods to be withdrawn from the bottoms of the cylinders, when disconnected from the crankshafts, without interference from the crankshafts. The cylinders are inclined to the horizontal and define a substantially V-shaped combustion chamber. The engine is particularly suited for use in vehicles and is provided with a mounting arrangement which promotes pivoting of the engine in the event of a collision rather than projection of the engine through a firewall of the vehicle.

2 Claims, 5 Drawing Figures

TWIN PISTON-PER-CYLINDER ENGINE

BACKGROUND OF THE INVENTION

This invention relates to internal combustion engines, more particularly engines for automotive use. The invention provides, in one of its aspects, an engine having an opposed cylinder configuration of unique design which provides efficient fuel utilization and which facilitates servicing of the engine, more particularly removal of the pistons and connecting rods. In another of its aspects, the invention provides a mounting arrangement for an engine in a vehicle which provides enhanced vehicle safety in the event of a collision.

STATEMENT OF PRIOR ART

The following U.S. patents are considered relevant to the present invention, but do not disclose the concepts embodied therein. U.S. Pat. No. 577,160 U.S. Pat. No. 727,455 U.S. Pat. No. 1,221,094 U.S. Pat. No. 1,533,004 U.S. Pat. No. 1,780,454 U.S. Pat. No. 1,900,587 U.S. Pat. No. 2,097,742 U.S. Pat. No. 2,486,185 U.S. Pat. No. 4,010,611

SUMMARY OF THE INVENTION

In its first aspect, the invention provides an internal combustion engine having opposed cylinders with a common centrally disposed combustion chamber, pistons and connecting rods in the respective cylinders and crankshafts for the respective pistons disposed outwardly of the cylinders. In a preferred form of the invention, the cylinders may be disposed in generally horizontally opposed relation inclined slightly downwardly away from the common combustion chamber. This provides an effective combustion chamber design with minimum piston clearance at the bottom of the chamber while allowing ample room at the top of the chamber for a spark plug (in an S.I. engine) and inlet and exhaust valves. Also, it is preferred that the distance between the bottom of each cylinder and the respective crankshaft is sufficient to allow withdrawal of the respective piston and connecting rod through the bottom of the cylinder, upon disconnection of the connecting rod from the crankshaft, without interference from crankshaft counterweights and the like. In an automobile engine, for example, this allows for removable crankcase covers to be located at the top of the engine providing access to the pistons and connecting rods, without having to remove the engine from the vehicle.

In its second aspect, the invention provides pivotal, two-point mounting of an engine in the engine compartment of a vehicle which promotes downward pivoting of the engine in the event of a front end collision, rather than rearward projection of the engine towards the passenger compartment of the vehicle.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

The drawings show an internal combustion engine 10 mounted between frame members 12, 14 in a vehicle engine compartment having a firewall 16 separating the engine compartment from a passenger compartment of the vehicle.

Figure 3:
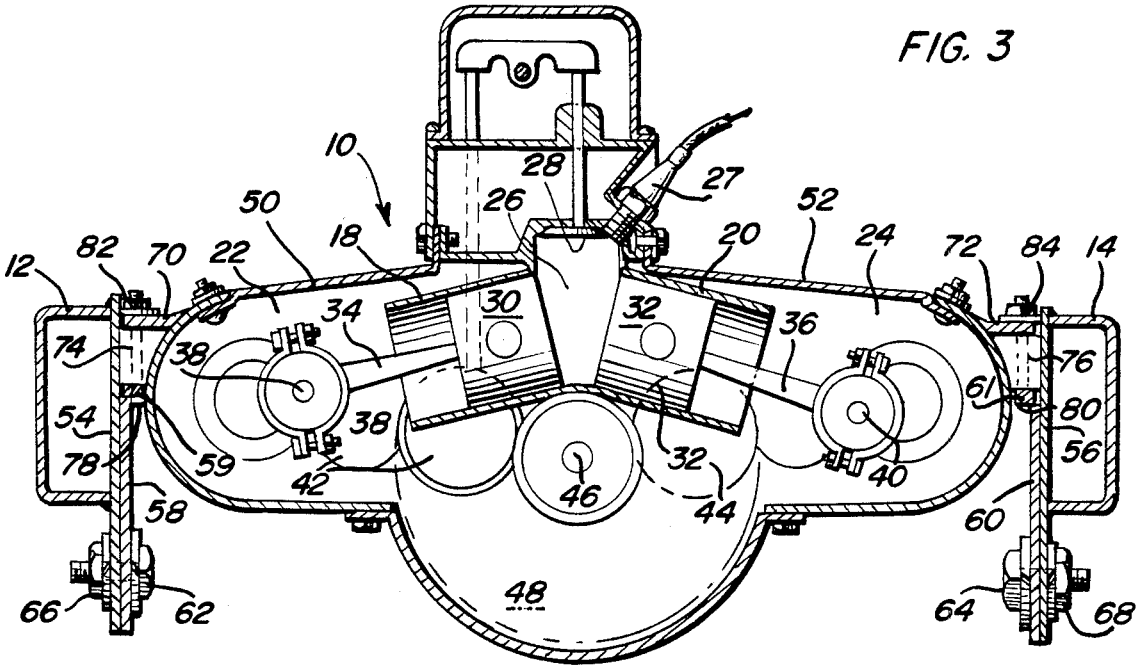
FIG. 3 is a somewhat diagrammatic cross-sectional view of the combination taken generally along section line 3—3 on FIG. 1.

The engine has three pairs of horizontally opposed cylinders, one pair 18 and 20 of which are shown in FIG. 3. The cylinders are in communication with respective crankcases 22 and 24, and each pair of cylinders has a central common combustion chamber 26 with a spark plug 27 (for an S.I. engine) and valves such as valve 28 communicating with the top of the combustion chamber. The blocks defining the respective cylinders are inclined slightly downwardly away from the central combustion chambers, and the cylinders are provided with respective pistons 30, 32 with connecting rods 34, 36 attached between the respective pistons and outwardly located crankshafts 38, 40 illustrated diagrammatically in FIG. 3. The crankshafts have drive connections 42, 44 which may comprise gear, or belt drives or the like, with a common central output shaft 46 having a flywheel 48.

It will be understood that the drawings are illustrative of the principles of the invention only, and constructional details of the engine, such as the design of the cylinder blocks, crankshaft, connecting rod and crankshaft connections, crankshaft bearings, carburation, valving, valve drive mechanisms, lubrication and the like, may follow conventional engineering practice well known in the engine art.

An important feature of the invention is the opposed piston configuration using a common central combustion chamber and cylinders which incline downwardly from the combustion chamber. The common chamber makes efficient use of the explosive force of a charge of mixture on the working strokes of the engine by expanding the force against a pair of moving pistons, and the inclined nature of the cylinders provides a V-shaped combustion chamber with ample room for fitting the spark plugs and valves at the top of the chamber while maintaining good overall gas compression.

Another important feature of the invention resides in spacing the crankshafts a sufficient distance from the bottom of the cylinders to allow the pistons to be withdrawn through the bottom of the cylinders, when the connecting rods are detached from their respective crankpins, without interference from any parts of the crankshafts, particularly counterweights on opposite sides of the crankpins. This arrangement allows the pistons to be withdrawn from the crankcases from the top, without having to remove the engine from its compartment in a vehicle. Removable crankcase covers 50, 52 are provided for this purpose.

Figure 2:
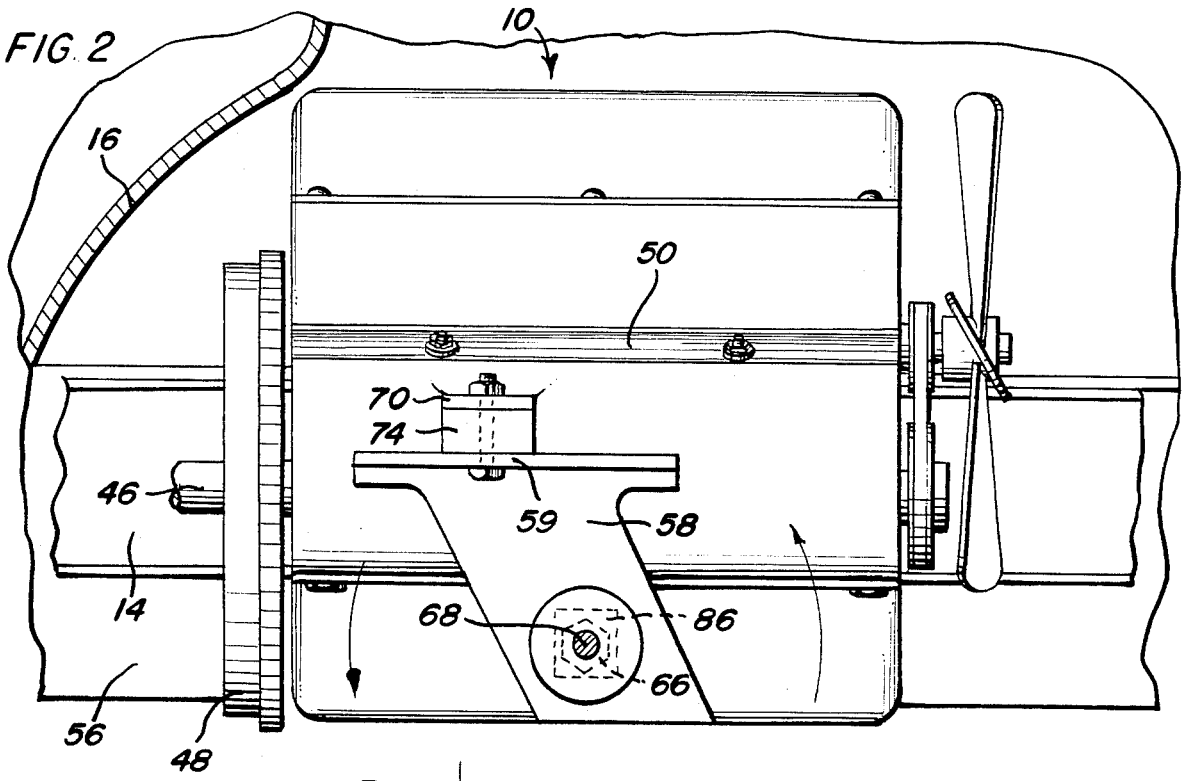
FIG. 2 is an elevational view of the combination shown in FIG. 1.
Figure 1:
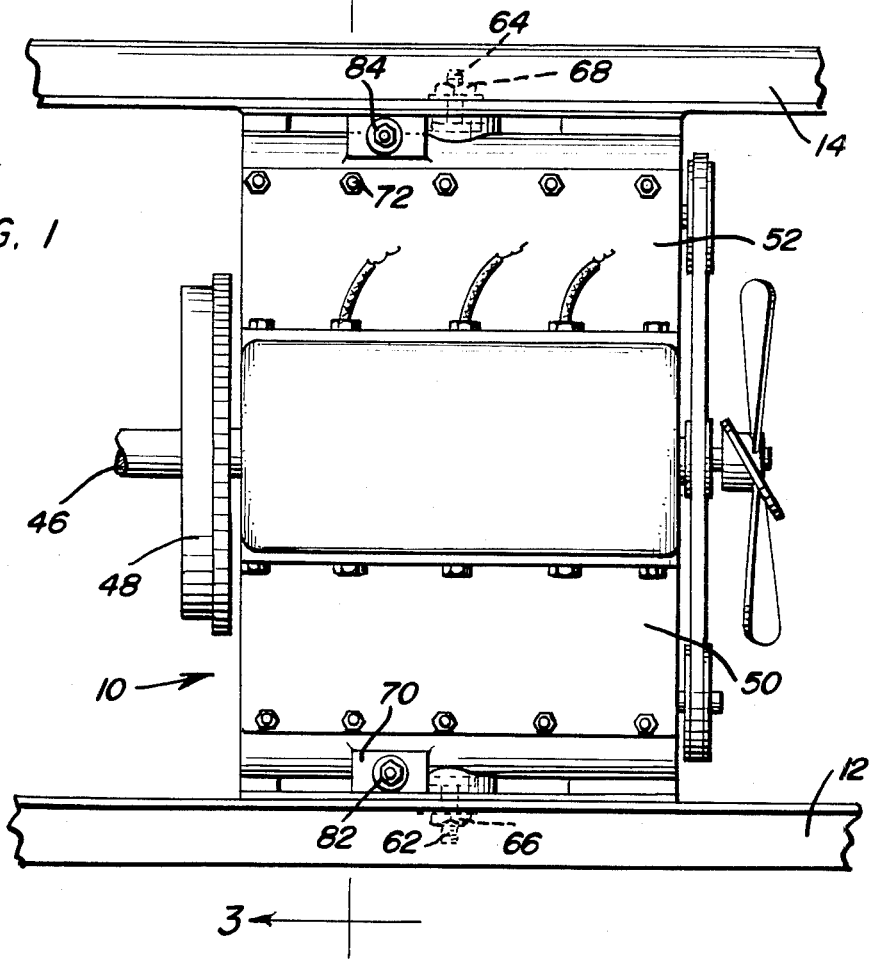
FIG. 1 is a plan view of an engine mounted in the engine compartment of a vehicle in accordance with the invention.
Figure 4:
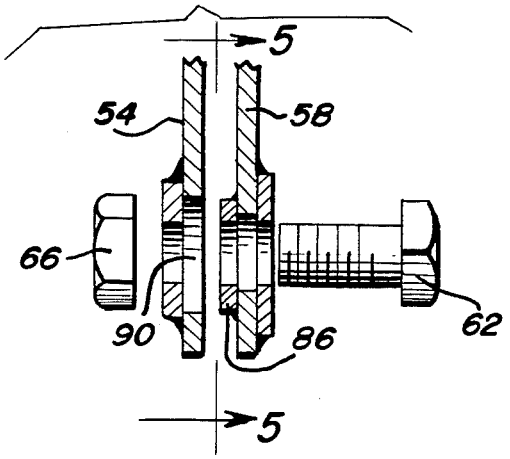
FIG. 4 is an exploded view of parts of the engine mounting assembly.
Figure 5:
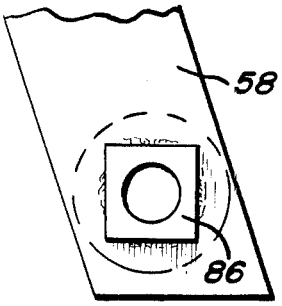
FIG. 5 sectional view on line 5—5 of FIG. 4.

The engine is mounted on frame members 12, 14 by a mounting arrangement which promotes pivoting of the engine as shown by the arrows in FIG. 2, rather than projection of the engine rearwardly against the firewall in the event of a front end collision. To this end, a two-point mounting arrangement is used in place of the four-point system commonly used for vehicle engines. Frame members 12 and 14 may, for example, have inside plates 54, 56 welded thereto extending below the level of the frame members, and the engine may be attached between these plates by inclined brackets 58, 60, the lower ends of which are attached to plates 54, 56 by respective bolts 62, 64 and nuts 66, 68. At their upper ends, brackets 58, 60 are provided with horizontal plates 59, 61 attached to opposite sides of the engine through shock-absorbing fittings comprising plates 70, 72 welded to the engine, shock-absorbing rubber blocks 74, 76, bolts 78, 80, and nuts 82, 84. To stabilize and prevent pivoting of the engine under normal operation, non-circular shear plates, such as plate 86 (FIGS. 4 and 5) may be welded to the exterior of brackets 58, 60, so as to fit in complementary non-circular openings, such as opening 90 in plates 54, 56. In normal operation, the shear plates stabilize the engine in the engine compartment, however in the event of a front end collision, plates 86, 88 may shear away from brackets 58, 60 allowing the engine to pivot as indicated in FIG. 2 and avoiding projection of the engine into the firewall.

Engines in accordance with the invention may be made in spark ignition or compression ignition models, and in various sizes, power outputs, and numbers of cylinders.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In an internal combustion engine comprising opposed cylinders defining a common centrally disposed combustion chamber therebetween, the improvement wherein the cylinders are mutually inclined to define a substantially V-shaped combustion chamber when pistons associated the respective cylinders are at their top dead center positions, the engine including crank shafts for the respective pistons located outwardly of the cylinders by a distance sufficient to allow the pistons and connecting rods when disconnected from the crank shafts to be withdrawn from the bottoms of the respective cylinders without interference from the crank shafts, wherein the cylinders are substantially horizontally opposed, wherein the engine includes removable crank case covers at the top of the engine for obtaining access to the pistons and connecting rods and for removal thereof, wherein the engine includes a mounting bracket on each side for providing 2-point mounting of the engine in a vehicle engine compartment in a manner promoting pivoting of the engine in the event of a collision rather than projecting the engine against a fire wall of the vehicle, wherein each mounting bracket includes a generally vertically extending bracket member having its upper end attached to the side of an engine intermediate the ends thereof with the lower end of the bracket member depending from the point of attachment with the engine, and a vertically extending support member attached to a vehicle frame at its upper end and depending alongside said bracket member, and means securing the bracket member and support member together to enable pivotal movement about a transverse axis upon application of force to the forward end of the engine above the transverse axis as would occur in the event the front end of the vehicle collided with another vehicle or a stationary object, wherein said means pivotally connecting the bracket member and support member includes a pivot bolt and a shim member interconnected the bracket member and support member to prevent pivotal movement of the engine until predetermined force has been applied to the engine sufficient to rupture the shear member after which the engine may pivot about a transverse axis defined by the bolt, and wherein said shear member is a polygonal projection rigidly affixed to the bracket member, said support member including a correspondingly shaped recess receiving the projection, said projection and recess being concentrically arranged with respect to the pivot bolt to prevent rotational movement of the bracket member and engine with respect to the support member until the polygonal projection has been broken away from the bracket member.

2. The internal combustion engine as defined in claim 1 wherein the upper end of each bracket member is attached to the engine through resilient shock absorbing means at a point above the rotational axis of the crank shafts thereby lowering the engine in relation to the vehicle frame for lowering the center of gravity of the vehicle engine with respect to the vehicle frame members and lowering the profile of the engine in relation to the vehicle frame members.

* * * * *